US005545021A

United States Patent [19]

Fukuoka et al.

[11] Patent Number: 5,545,021

[45] Date of Patent: Aug. 13, 1996

[54] HERMETICALLY SEALED ROTARY COMPRESSOR HAVING AN OIL SUPPLY CAPILLARY PASSAGE

[75] Inventors: Hirotsugu Fukuoka, Kusatsu; Keisuke Morita, Otsu; Hiroshi Matsunaga; Shigeru Muramatsu, both of Kusatsu, all of Japan

[73] Assignee: Matsushita Electric Industrial Co., Ltd., Osaka-fu, Japan

[21] Appl. No.: 359,656

[22] Filed: Dec. 20, 1994

[30] Foreign Application Priority Data

Dec. 21, 1993 [JP] Japan ..... 5-321648
Oct. 17, 1994 [JP] Japan ..... 6-250416

[51] Int. Cl.[6] ..... F04C 18/356; F04C 29/02

[52] U.S. Cl. ..... 418/63; 418/85; 418/97; 418/99

[58] Field of Search ..... 418/63, 85, 97, 418/99

[56] References Cited

U.S. PATENT DOCUMENTS

| | | | |
|---|---|---|---|
| 1,970,033 | 8/1934 | Dennedy | 418/85 |
| 2,616,616 | 11/1952 | Wolff | 418/85 |
| 3,016,184 | 1/1962 | Hart | 418/85 |
| 3,904,321 | 9/1975 | Ruedi et al. | 418/97 |
| 4,737,088 | 4/1988 | Taniguchi et al. | 418/85 |
| 5,217,360 | 6/1993 | Kawahara et al. | 418/85 |

FOREIGN PATENT DOCUMENTS

| | | | |
|---|---|---|---|
| 4722035 | 6/1972 | Japan | 418/85 |
| 57-173589 | 10/1982 | Japan . | |
| 59-136596 | 8/1984 | Japan | 418/99 |

*Primary Examiner*—John J. Vrablik
*Attorney, Agent, or Firm*—Wenderoth, Lind & Ponack

[57] ABSTRACT

A hermetically sealed rotary compressor includes a generally cylindrical sealed vessel having an oil reservoir defined therein for accommodating a quantity of lubricating oil, a drive unit within the sealed vessel, and a compressor mechanism within the sealed vessel. The compressor mechanism includes a cylinder having a compression compartment defined therein and also having upper and lower openings, an eccentric cam provided on a crankshaft for rotation together therewith, and a ring-shaped piston mounted on the crankshaft while encircling the eccentric cam and capable of undergoing a planetary motion in contact with the eccentric cam during rotation of the eccentric cam. The cylinder has a refrigerant intake port defined therein in communication with the compression compartment. A radial vane is slidably accommodated in the cylinder for reciprocating movement in a direction radially of the cylinder and having a radial inner end held in sliding contact with an outer peripheral surface of the ring-shaped piston. An oil supply tube having first and second open ends opposite to each other is disposed with the first open end communicated with the oil reservoir and the second open end communicated with the compression compartment while a generally intermediate portion of the oil supply tube extends outside the sealed vessel.

36 Claims, 14 Drawing Sheets

HERMETICALLY SEALED ROTARY COMPRESSOR HAVING AN OIL SUPPLY CAPILLARY PASSAGE

BACKGROUND OF THE INVENTION

1. Field of the Invention

The present invention generally relates to a hermetically sealed rotary compressor and, more particularly, to the hermetically sealed rotary compressor of a type suited for use in a refrigerator, an air-conditioner or the like for compressing a gas-phase refrigerant.

2. Description of the Prior Art

The hermetically sealed rotary compressor is well known in the art, an example of which is shown in FIGS. 24 and 25 in longitudinal and transverse sectional representations, respectively, for discussion of the prior art believed to be relevant to the present invention.

The hermetically sealed rotary compressor shown in FIGS. 24 and 25 includes a generally cylindrical sealed vessel 1 tightly closed at its opposite ends and accommodating therein an electric motor 3 comprised of a stator and a rotor. This sealed vessel 1 also accommodates therein a compressor mechanism 4 positioned beneath the electric motor 3 and adapted to be driven by the electric motor 3. During the drive of the compressor mechanism 4, a refrigerant introduced into the compressor mechanism from a gas-liquid separator 14 through an intake port 15 by way of a connecting tube 25 is compressed. The resultant compressed refrigerant is discharged into the sealed vessel through an outlet port and then therefrom to a refrigerating circuit through a discharge tube 16.

The compressor mechanism 4 of the prior art rotary compressor comprises, as best shown in FIGS. 24 and 25, a crankshaft 5 adapted to be driven by the electric motor 3 and having its upper and lower ends rotatably received by upper and lower bearing plates 9 and 10, respectively, a generally intermediate portion of said crankshaft 5 extending through a cylinder 6 fixed in position inside the sealed vessel 1. An eccentric cam 7 is fixedly mounted on, or otherwise formed integrally with, a portion of the crankshaft 5 situated within the cylinder 6 for rotation together therewith. A ring-shaped piston 8 is operatively positioned between an inner wall surface of the cylinder 6 and an outer peripheral surface of the eccentric cam 7 and will, during the drive of the crankshaft 5, undergo a planetary motion.

As best shown in FIG. 25, the cylinder 6 has a radial groove 11 defined therein so as to extend in a direction radially thereof, and a slidable radial vane 12 is accommodated within this radial groove 11 for movement within the radial groove 11 in a direction close towards and away from the crankshaft 5. This slidable radial vane 12 is normally biased by a biasing spring 19 in one direction with a radially inward end thereof held in sliding contact with an outer peripheral surface of the ring-shaped piston 8, thereby dividing the volume of the cylinder 6 into volumetrically variable, low and high pressure chambers 17 and 18 that are defined respectively on leading and trailing sides of the slidable radial vane 12 with respect to the direction of rotation of the crankshaft 5.

According to the prior art hermetically sealed rotary compressor shown in FIGS. 24 and 25, a gas-phase refrigerant is, during the planetary motion of the ring-shaped piston 8 accompanying an eccentric rotation of the eccentric cam 7 rigid with the crankshaft 8, sucked into the low pressure chamber 17 through the intake port 15 and then compressed before it is discharged through the outlet port (not shown). In order to facilitate a sliding motion of the ring-shaped piston 8 relative to the inner wall surface of the cylinder 6 and the radial inner end of the slidable radial vane 12 and also a sliding motion of the radial vane 12 within the radial groove 11, a quantity of lubricating oil is accommodated within the sealed vessel 1 as indicated by 2 in FIG. 24. The lubricating oil 2 is sucked up by an oil pump 13 operatively disposed below the lower end of the crankshaft 5 to oil various sliding elements within the compressor mechanism 4.

Of the various sliding elements used in the compressor mechanism 4, the slidable radial vane 12 when noticeably worn out causes a detrimental problem. As is well known to those skilled in the art, the slidable radial vane 12 is frictionally engaged not only with the ring-shaped piston 8, but also with side surfaces defining the radial groove 11 in the cylinder 6. Specifically, by the biasing force of the biasing spring 19 and a back pressure acting on a radial outer end of the slidable radial vane 12, the radial inner end of the slidable radial vane 12 is constantly held in frictional engagement with the ring-shaped piston 8 and, also, by the effect of a pressure difference between the low and high pressure chambers 17 and 18, opposite side surfaces of the slidable radial vane 12 are alternately held in frictional engagement with the corresponding side surfaces of the radial groove 11. Unlike other sliding elements such as, for example, the crankshaft and its bearing mechanism, the slidable radial vane 12 is not lubricated by a lubricating oil supplied directly by the oil pump 13, but is lubricated by an oil component, contained in the refrigerant being compressed, and/or an oil leaking from bearing rollers. The quantity of the oil available from the refrigerant being compressed and leaking from the bearing rollers is indeed insufficient for lubricating the slidable radial vane 12 and its surrounding parts satisfactorily. In addition, considering that the refrigerant when compressed is in elevated temperature, the slidable radial vane 12 in contact with the refrigerant being compressed is therefore heated and is therefore susceptible to an accelerated frictional wear.

In order to eliminate the above discussed problems, the Japanese Laid-open Patent Publication No. 4-203286 suggests the use of such an oil injector mechanism as shown in FIG. 26. The refrigerating circuit disclosed in this publication includes a condenser 38 fluid-connected with an expansion valve 39 through a connecting tube 40 having a by-pass passage 41 branched off therefrom for injecting an oil and a liquid-phase refrigerant into the low pressure chamber 17. This by-pass passage 41 has an oil reservoir 42 disposed thereon, and oil within the oil reservoir 42 is introduced into the low pressure chamber 17 by the effect of a developed pressure difference to thereby lubricate the ring-shaped piston 8 and the slidable radial vane 12. Since the mere supply of oil will result in reduction in efficiency because of ingress of heated oil into the cylinder, the oil is mixed with the liquid-phase refrigerant to prevent the interior of the cylinder from being heated.

For the refrigerant used in the refrigerating system including the hermetically sealed rotary compressor, dichlorodifluoromethane (hereinafter referred to as "CFC 12") or hydrochlorofluoromethane (hereinafter referred to as "HCFC 22") is generally used. On the other hand, the lubricant oil filled in the compressor mechanism 5 is generally either a mineral oil of naphthene or that of paraffin having a solubility with CFC 12 or HCFC 22.

Since the refrigerant and the lubricating oil circulate directly within the sealed vessel 1, the various component parts of the compressor mechanism 4 must have a sufficient resistance to wear.

Apart from the above, it has come to be recognized that emission of Freon such as used as the refrigerant into the atmosphere does not only seriously deplete the ozone layer, but brings about global ecological damage. In view of this, an international agreement has been made to step by step freeze for some years ahead and eventually abolish the production of CFC 12 and HCFC 22. Under these circumstances, as a substitute refrigerant, 1,1,2-tetrafluoroethane (hereinafter referred to as "HFC 134a"), 1,1 difluoroethane (hereinafter referred to as "HFC 152a" and hydrodifluoromethane (hereinafter referred to as "HFC 32") or a mixture thereof have been developed.

While the substitute refrigerant such as HFCs 134a, 152a and 32 is less likely to result in depletion of the ozone layer, it lacks a solubility with such a mineral lubricant as hitherto used in combination with the CFC 12 or HCFC 22. For this reason, where the substitute refrigerant is to be used in the refrigerating system, attempts have been made to use such a lubricant oil of ether, ester or fluorine family which has a compatibility with the substitute refrigerant.

However, where a combination of any one of the HFCs 134a, 152a and 32 in place of any of the CFC 12 and HCFC 22 with either polyalkylene glycol oil or polyester oil having a compatibility with such substitute refrigerant is used in the refrigerant compressor, it has been found that the resistance to frictional wear of such metallic material as FC25, special cast iron, sintered alloy and stainless steel used for sliding elements in the refrigerant compressor tends to be lowered and, therefore, the refrigerant compressor cannot be operated stably for a long period of time. This is because of the following reasons.

So long as the conventional CFC 12 or HCFC 22 is used as the refrigerant, chlorine atoms contained in the conventional refrigerant react with Fe atoms contained in the metal matrix to form a film of ferric chloride that is excellent in resistance to frictional wear. However, in the case of the substitute refrigerant such as HFC 134a, HFC 152a or HFC 32, no chlorine atom exist in this compound and, therefore, no lubricating film such as a film of ferric chloride is formed, accompanied by a reduction in lubricating action.

In addition, while the conventional mineral oil used as a lubricant contains a cyclic compound and has therefore a relatively high capability of forming an oil film, the lubricant oil compatible with the substitute refrigerant is composed mainly of a chain compound and is therefore unable to form a required oil film under severe sliding conditions, accompanied by an accelerated reduction in resistance to frictional wear.

As discussed above, the refrigerant compressor operable with the substitute refrigerant and the lubricant oil compatible with this substitute refrigerant is often placed under severe sliding conditions not only during a high load drive, but also during a normal drive and, therefore, the frictional wear of the vane and rollers has come to be highlighted.

According to the solution suggested in the previously discussed publication with reference to FIG. 26 in which an oil injector is used to supply a relatively great amount of lubricant oil to the vane and rollers in an attempt to eliminate the above discussed problems, there is a problem in that the refrigerating system tends to be complicated and costly.

Mere connection of the oil reservoir with the low pressure chamber such as employed in the previously discussed publication brings about an additional problem in that a high temperature oil tends to flow into a low temperature chamber to superheat the refrigerant being sucked, accompanied by reduction in efficiency of the compressor.

SUMMARY OF THE INVENTION

The present invention has been devised to substantially eliminate the previously discussed problems inherent in the prior art refrigerant compressor and is intended to provide an improved refrigerant compressor of a type wherein a simplified structural feature is used to permit an oil film to be readily formed to lubricate the vane and rollers even though the substitute refrigerant is used, to thereby increase the resistance to frictional wear and the lifetime of the compressor.

To this end, according to one aspect of the present invention, there is provided a hermetically sealed rotary compressor which comprises a generally cylindrical sealed vessel having an oil reservoir defined therein for accommodating a quantity of lubricating oil, and a drive unit housed within the sealed vessel. The drive unit includes a drive motor and a crankshaft adapted to be driven by the drive motor. The rotary compressor also comprises a compressor mechanism housed within the sealed vessel and including a cylinder having a compression compartment defined therein and also having upper and lower openings, an eccentric cam provided on the crankshaft for rotation together therewith, and a ring-shaped piston encircling the eccentric cam and capable of undergoing a planetary motion in contact with the eccentric cam during rotation of the eccentric cam. The cylinder has a refrigerant intake port defined therein in communication with the compression compartment and also has a capillary passage defined therein so as to extend radially thereof in communication with the compression compartment at a location adjacent the refrigerant intake port. Upper and lower bearing plates close the upper and lower openings of the cylinder, respectively. A radial vane is slidably accommodated in the cylinder for reciprocating movement in a direction radially of the cylinder and having a radial inner end held in sliding contact with an outer peripheral surface of the ring-shaped piston. An oil supply tube having first and second open ends opposite to each other is disposed with the first open end communicated with the oil reservoir and the second open end communicated with the capillary passage while a generally intermediate portion of the oil supply tube extends outside the sealed vessel.

Preferably, a heat exchanger is disposed on the intermediate portion of the oil supply tube. Also, regardless of the use or non-use of the heat exchanger, a flow regulating valve may be disposed on the oil supply tube. Where the heat exchanger is employed, the flow regulating valve may be disposed on the intermediate portion of the oil supply tube.

The refrigerant intake port may be communicated with a gas-liquid separator.

Alternatively, the capillary passage may be defined in at least one of the upper and lower bearing plates so as to extend radially thereof in communication with the compression compartment at a location adjacent the refrigerant intake port.

Again alternatively, where the refrigerant intake port is fluid-connected with an air-liquid separator through a connecting tube, the oil supply tube may have its second open end communicated through an orifice with a portion of the connecting tube positioned outside the sealed vessel and, in this case, a generally intermediate portion of the oil supply tube is positioned outside the sealed vessel. Even in this case, a heat exchanger may be disposed on the intermediate portion of the oil supply tube.

The hermetically sealed rotary compressor according to the present invention may be used, and is particularly suited for use, in a refrigerant circulating circuit through which a refrigerant in the form of one or a mixture of hydrofluorocarbons circulates. In this case, the lubricant oil has a compatibility with the refrigerant used.

According to another aspect of the present invention, there is provided a hermetically sealed rotary compressor which comprises a generally cylindrical sealed vessel having an oil reservoir defined therein for accommodating a quantity of lubricating oil, a drive unit housed within the sealed vessel and including a drive motor and a crankshaft adapted to be driven by the drive motor, and a compressor mechanism housed within the sealed vessel. The compressor mechanism includes a cylinder having a compression compartment defined therein and also having upper and lower openings, an eccentric cam provided on the crankshaft for rotation together therewith, and a ring-shaped piston encircling the eccentric cam and capable of undergoing a planetary motion in contact with the eccentric cam during rotation of the eccentric cam, the cylinder also having a refrigerant intake port and a refrigerant outlet port defined therein for introduction and discharge of a refrigerant into and from the compression compartment. Upper and lower bearing plates close the upper and lower openings of the cylinder while rotatably supporting the crankshaft with the eccentric cam housed within the compression compartment. A radial vane is slidably accommodated in a radial groove defined in the cylinder for reciprocating movement in a direction radially of the cylinder and having a radial inner end held in sliding contact with an outer peripheral surface of the ring-shaped piston while dividing the compression compartment into leading and trailing chambers with respect to a direction of rotation of the crankshaft. A top cover plate closes a top opening of the radial groove and a bottom cover plate closes a bottom opening of the radial groove at a location corresponding to a top dead center of the radial vane and having a through-hole defined therein. An oil supply passage means has one end fluid-connected with the through-hole and the opposite end communicated with the trailing chamber, and an orifice is disposed in the oil supply passage means at a location adjacent the trailing chamber.

Where the hermetically sealed rotary compressor according to the present invention is used with the longitudinal axis thereof oriented horizontally, the oil supply passage means may have one end fluid-connected with a through-hole defined in the lower bearing plate and the opposite end fluid-connected with one end of the crankshaft adjacent the oil reservoir.

The opposite end of the oil supply passage means may be defined at such a location that the opposite end opens into the trailing chamber at a location ±60° with respect to a top dead center of the ring-shaped piston.

BRIEF DESCRIPTION OF THE DRAWINGS

This and other objects and features of the present invention will become clear from the following description taken in conjunction with preferred embodiments thereof with reference to the accompanying drawings, in which like parts are designated by like reference numerals and in which.

DETAILED DESCRIPTION OF THE EMBODIMENTS

Figure 1:
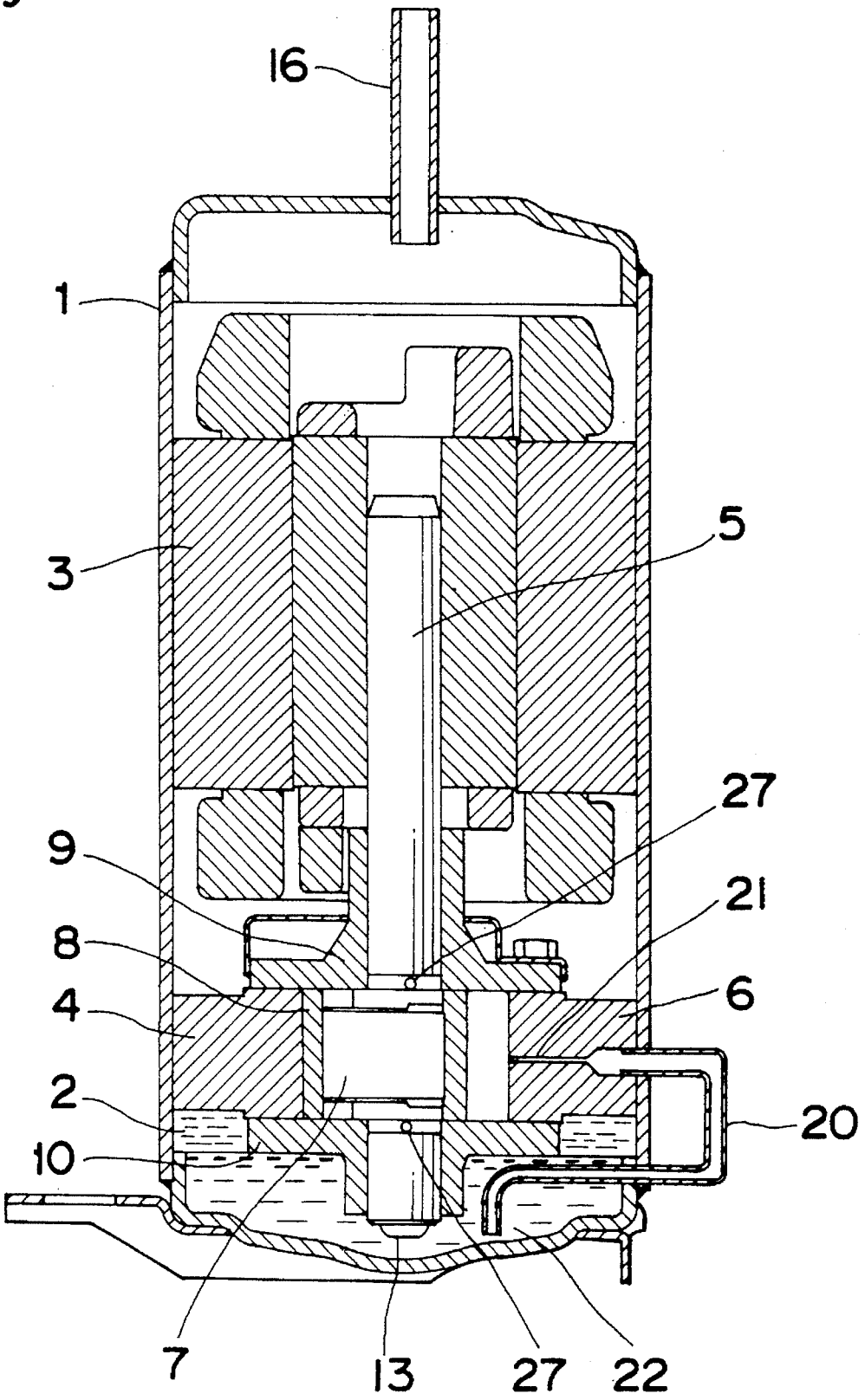
FIG. 1 is a longitudinal sectional view of a hermetically sealed rotary compressor according to a first preferred embodiment of the present invention.
Figure 2:
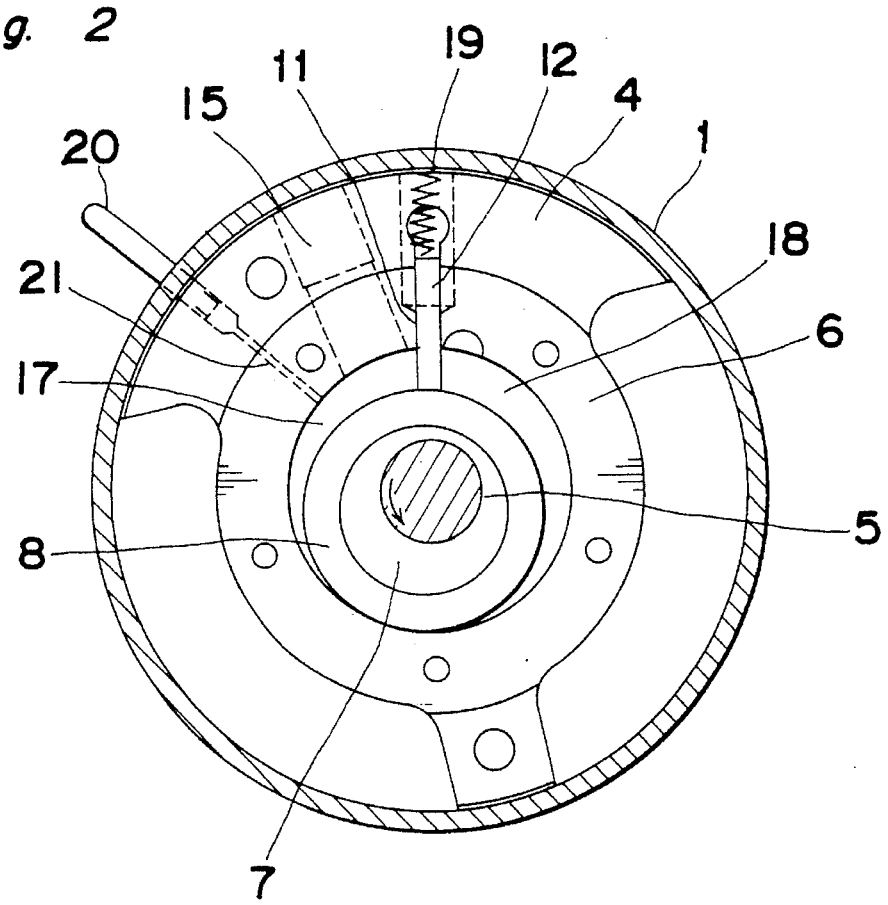
FIG. 2 is a transverse sectional view of a lower part of the rotary compressor shown in FIG. 1, showing the interior of a compressor cylinder.

A hermetically sealed rotary compressor according to a first preferred embodiment of the present invention is shown in FIGS. 1 and 2.

Figure 3:
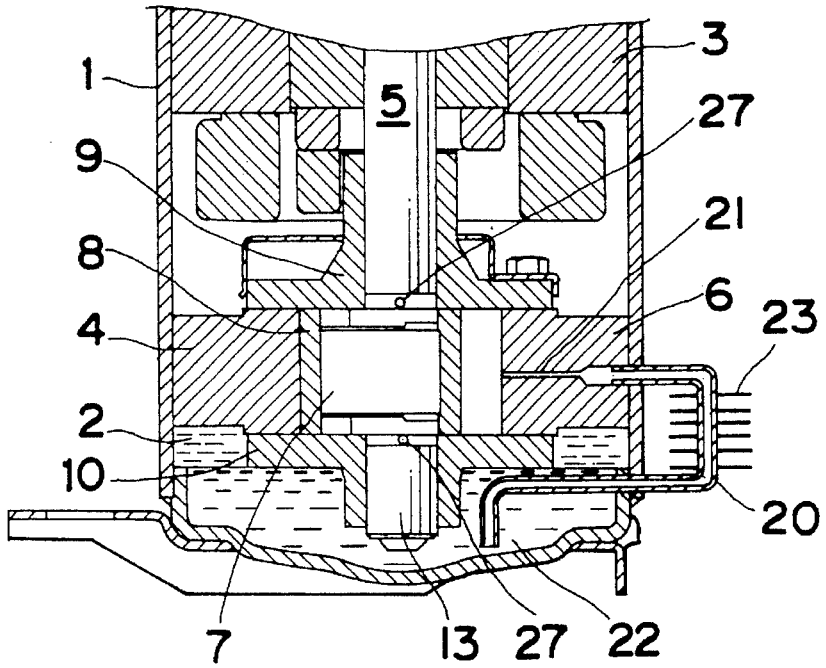
FIG. 3 is a longitudinal sectional view of the lower part of the rotary compressor according to a second preferred embodiment of the present invention.

Referring now to FIGS. 1 and 3, as is the case with the prior art hermetically sealed rotary compressor, the hermetically sealed rotary compressor shown therein includes a generally cylindrical sealed vessel 1 tightly closed at its opposite ends and accommodating therein an electric motor 3 comprised of a stator and a rotor. This sealed vessel 1 also accommodates therein a compressor mechanism 4 positioned beneath the electric motor 3 and adapted to be driven by the electric motor 3 through a crankshaft 5 journalled at its upper and lower ends to upper and lower bearing plates 9 and 10. The compressor mechanism 4 comprises, as best shown in FIG. 2, a cylinder 6 fixed in position inside the sealed vessel 1 and having its upper and lower openings closed by the upper and lower bearing plates 9 and 10 to define a compression compartment, an eccentric cam 7 fixedly mounted on, or otherwise formed integrally With, a portion of the crankshaft 5 situated within the cylinder 6 for rotation together therewith, and a ring-shaped piston 8 rotatably mounted on the eccentric cam 7 within the compression compartment of the cylinder 6 and capable of undergoing an eccentric motion in contact with the eccentric cam 7 during rotation of the crankshaft 7.

The cylinder 6 has a radial groove 11 defined in the wall thereof so as to extend in a direction radially thereof and carries a slidable radial vane 12 accommodated slidably within this radial groove 11 for movement in a direction towards and away from the crankshaft 5. This slidable radial vane 12 is normally biased by a biasing spring 19 in one direction with a radially inward end thereof held in sliding contact with an outer peripheral surface of the ring-shaped piston 8, thereby dividing the volume of the cylinder 6 into low and high pressure chambers 17 and 18 that are defined respectively on leading and trailing sides of the slidable radial vane 12 with respect to the direction of rotation of the crankshaft 5.

In order to facilitate a smooth sliding motion of the ring-shaped piston 8 relative to the inner wall surface of the cylinder 6 and the radial inner end of the slidable radial vane 12 and also a sliding motion of the radial vane 12 within the radial groove 11, a quantity of lubricating oil is accommodated, as indicated by 2 in FIG. 1, within an oil reservoir 22 defined in a bottom region of the sealed vessel 1. This lubricating oil 2 is sucked up by an oil pump 13 disposed below the lower bearing plate 10 and drivingly coupled with the crankshaft 5 to oil various sliding elements within the compressor mechanism 4 through a plurality of oil supply ports 27.

For the lubricating oil, naphthene, paraffin or alkylbenzene oil has been generally employed where the refrigerant to be compressed is either CFC12 or HCFC 22. Where the refrigerant to be compressed is HFC, ether or ester oil having a compatibility with the refrigerant is filled in the oil reservoir 22.

In order for the lubricating oil within the oil reservoir 22 to be supplied to the various sliding elements, an oil supply tube 20 is employed. This oil supply tube 20 has first and second open ends opposite to each other and is so disposed in the rotary compressor as to extend from the oil reservoir 22 within the sealed vessel 1 to a capillary passage 21 defined in the wall of the cylinder 6 so as to communicate with the compression compartment of the cylinder 6. More specifically, the oil supply tube 20 having the first open end communicated with the oil reservoir 22 extends from the oil reservoir 22 to the outside of the sealed vessel 1 and then from the outside of the sealed vessel 1 into the sealed vessel 1 with the second open end communicated with the capillary passage 21. Thus, the oil supply tube 20 has a substantially intermediate portion situated outside the sealed vessel 1. It is to be noted that the capillary passage communicated with the oil supply tube 20 in the manner described above opens into the compression compartment of the cylinder 6 at a location aligned with the volumetrically variable low pressure chamber 17.

In this structure, during the drive of the compressor mechanism 4, that is, the drive of the crankshaft 5 effected by the electric motor 3, the ring-shaped piston 8 undergoes a planetary motion to suck a refrigerant such as HFC through an intake port 15, and the resultant compressed refrigerant is discharged into the sealed vessel 1 and then therefrom to a refrigerating circuit through a discharge tube 16. During the continued rotation of the crankshaft 5, the radial vane 12 dividing the compression compartment of the cylinder 6 into the volumetrically variable low and high pressure chambers 17 and 18 in cooperation with the ring-shaped piston 8 reciprocately slides within the radial groove 11 with the radial inner end thereof constantly held in sliding contact with the ring-shaped piston 8 by the combined force of the biasing spring 19 and the back pressure acting thereon. A region of sliding contact between the radial inner end of the radial vane 12 and the ring-shaped piston 8 is mainly lubricated by a lubricant oil which is mixed in a slight quantity in the refrigerant being sucked through the intake port 15. The quantity of the lubricant sucked into the compression chamber of the cylinder 6 together with the refrigerant is so slight that no sufficient lubrication may be accomplished, and this is particularly true where HFC is employed for the refrigerant to be compressed.

The low pressure chamber 17 on the leading side of the radial vane 12 with respect to the direction of rotation of the crankshaft 5 is low in pressure and, therefore, by the effect of a pressure difference between the low pressure chamber 17 and the oil reservoir 22, the lubricating oil within the oil reservoir 22 is sucked into the oil supply tube 20 and then into the capillary passage 21.

The lubricating oil containing the refrigerant which is of a high temperature and under a high pressure so long as accommodated within the oil reservoir 22 is, as it is supplied through the oil supply tube 20, particularly through that intermediate portion of the oil supply tube 20 situated outside the sealed vessel 1, cooled and the pressure thereof is subsequently reduced as the lubricating oil having been so cooled flows through the capillary passage 21 in the wall of the cylinder 6. During the flow of the lubricating oil through the oil supply tube 20 and the capillary passage 21, the refrigerant contained in the lubricating oil is vaporized and the resultant vapor in turn cools the lubricating oil. Therefore, the lubricating oil of a reduced temperature is supplied into the low pressure chamber 17.

In the case of the prior art oil injection system, the oil reservoir has a capillary tube disposed therein and, therefore, reduction of the pressure of the lubricating oil has been effected within the capillary tube immersed in the lubricating oil within the oil reservoir. For this reason, even though the lubricating oil flowing through the capillary tube is cooled, the lubricating oil is again heated readily by exchange with heat of the lubricating oil within the oil reservoir and is then introduced into the low pressure chamber through the intake port, thereby constituting a cause of heating of the gas-phase refrigerant within the cylinder.

In contrast thereto, however, since the intermediate portion of the oil supply tube 20 is positioned outside the sealed vessel 1, the lubricating oil flowing through the oil supply tube 20 is in no way heated again, thereby avoiding a possible reduction in efficiency.

The lubricating oil introduced into the compression compartment of the cylinder 6 penetrates into a region of sliding contact between the radial inner end of the radial vane 12 and the ring-shaped piston 8 to form an oil film to thereby minimize any possible frictional wear of one or both of the radial vane 12 and the ring-shaped piston 8. The lubricating oil after having been used to oil the sliding region is subsequently discharged from the compressor mechanism 4 together with the compressed refrigerant, most of which is then thrown off as it flows through cutouts in the electric motor 3 so as to return to the oil reservoir 2. In this way, the quantity of the lubricating oil which may be circulated through the refrigerating circuit is minimized to avoid any possible reduction in heat exchange efficiency of a heat exchanger while increasing the refrigerating efficiency.

It is to be noted that the higher the pressure difference, the more the lubricating oil is mixed. Hence, the higher the pressure difference, the more the lubricating oil is introduced into the sliding region, accompanied by an increase in reliability.

While in the foregoing description, reference has been made to the use of the HFC refrigerant being compressed, the present invention may not be limited to the use of the HFC refrigerant and may be equally applicable to the use of any other conventional refrigerant such as CFC 12 or HCFC 22. Even where the conventional refrigerant such as CFC 12 or HCFC 22 is employed for the refrigerant being compressed in the rotary compressor, effects similar to those discussed above can be obtained.

FIG. 3 illustrates a second preferred embodiment of the present invention. According to this embodiment, a heat exchanger 23 is employed to facilitate cooling of the lubricating oil flowing through the oil supply tube 20. The heat exchanger shown in FIG. 3 is in the form of a plurality of regularly spaced fins mounted on that portion of the oil supply tube 20 situated outside the sealed vessel 1.

Figure 4:
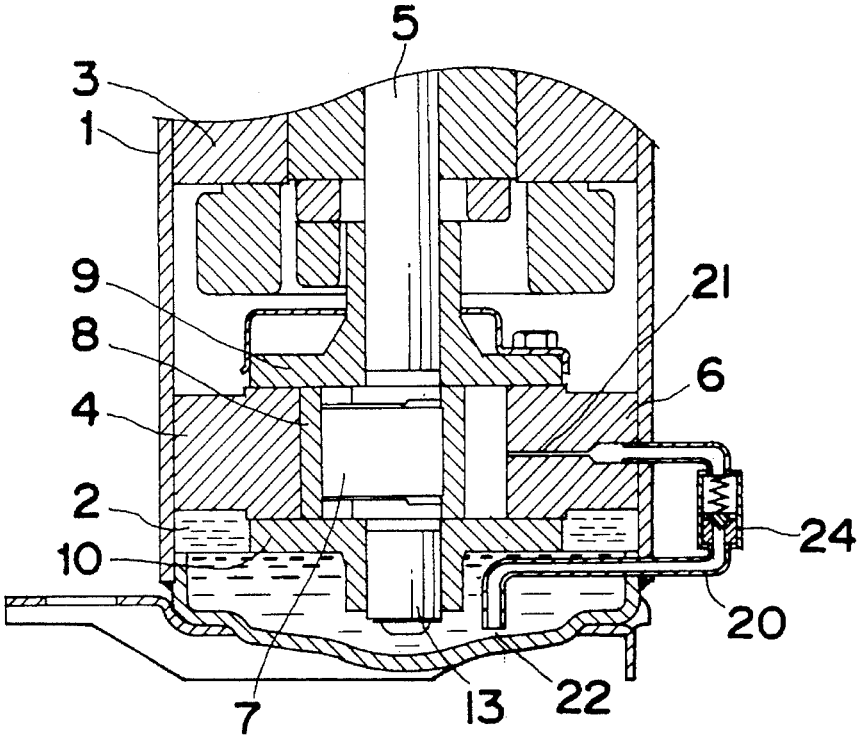
FIGS. 4 to 6 are views similar to FIG. 3, showing third to fifth preferred embodiments of the present invention, respectively.

FIG. 4 illustrates a third preferred embodiment of the present invention. According to this third embodiment of the present invention, the flow of the lubricating oil through the oil supply tube 20 is regulated to facilitate an increase of the operating efficiency of the rotary compressor. For this purpose, a flow regulator valve 24 is disposed on that portion of the oil supply tube 20 situated outside the sealed vessel 1.

Figure 5:
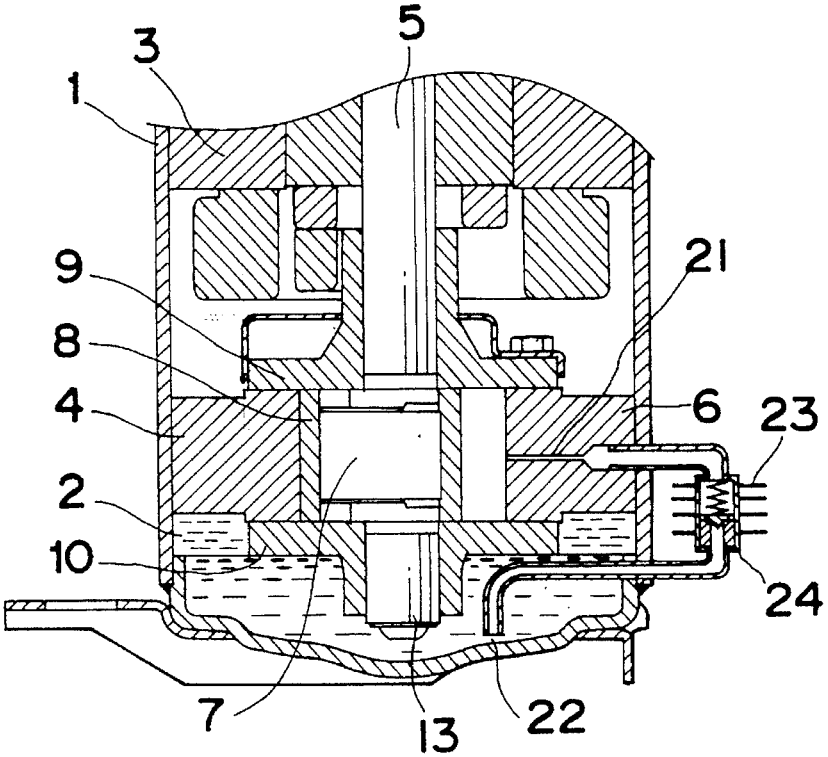

According to a fourth preferred embodiment of the present invention shown in FIG. 5, the flow regulator valve 24 shown in FIG. 4 is externally provided with the heat exchanger 23 shown in FIG. 3 to facilitate cooling of the lubricating oil flowing through that portion of the oil supply tube 20 situated outside the sealed vessel.

Figure 6:
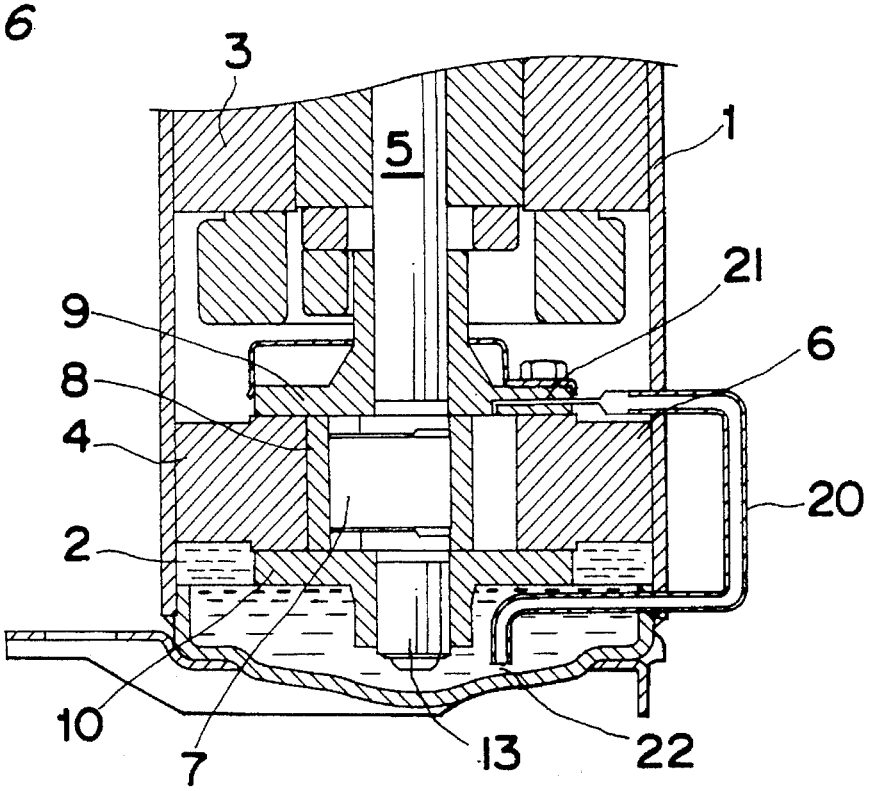
Figure 8:
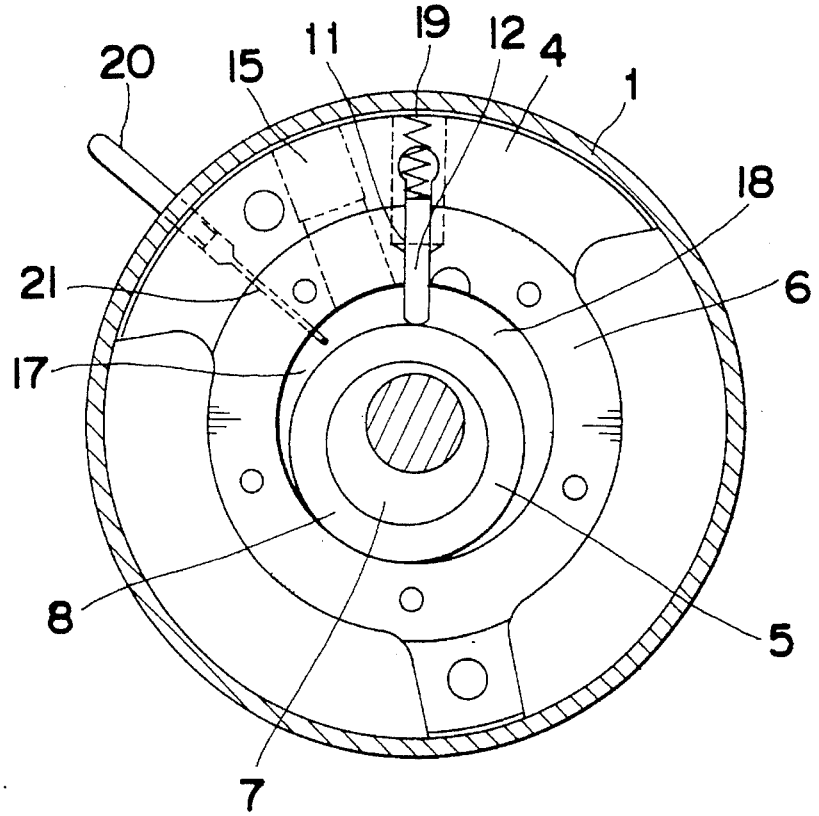
FIG. 8 is a transverse sectional view of the lower part of the rotary compressor shown in any one of FIGS. 6 and 7.

FIGS. 6 and 8 illustrate a fifth preferred embodiment of the present invention. In this embodiment, while the first open end of the oil supply tube 20 is immersed within the oil reservoir 22 as is the case with any one of the foregoing embodiments, the second open end of the oil supply tube 20 is communicated with the capillary passage 21 which is, in this embodiment, defined in one of the upper and lower bearing plates, for example, the upper bearing plate 9. This capillary passage 21 is in turn communicated with the low pressure chamber 17 through an opening defined in the upper bearing plate 9. As FIG. 8 makes clear, by suitably choosing the position of the capillary passage 21, the timing at which the capillary passage 21 is opened can be adjusted, and therefore, it is possible to accomplish the supply of an optimum quantity of lubricating oil.

Figure 7:
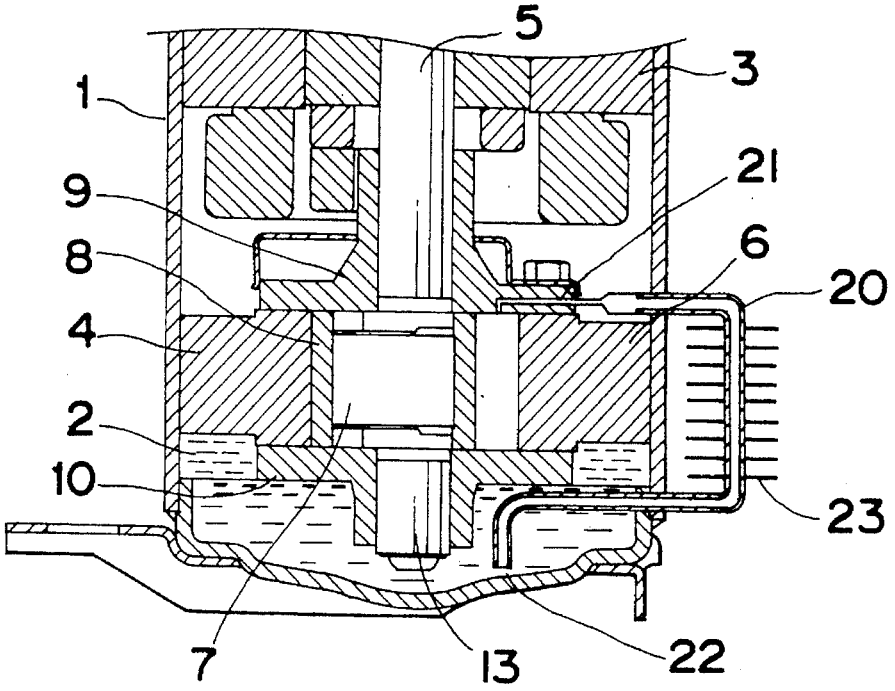
FIG. 7 is a view similar to FIG. 3, showing a modification of the fifth preferred embodiment of the present invention.

The fifth preferred embodiment of the present invention shown in and described with reference to FIG. 6 may be modified as shown in FIG. 7. In the modification shown in FIG. 7, that portion of the oil supply tube 20 extending outside the sealed vessel I may be provided with the heat exchanger 23.

Figure 9:
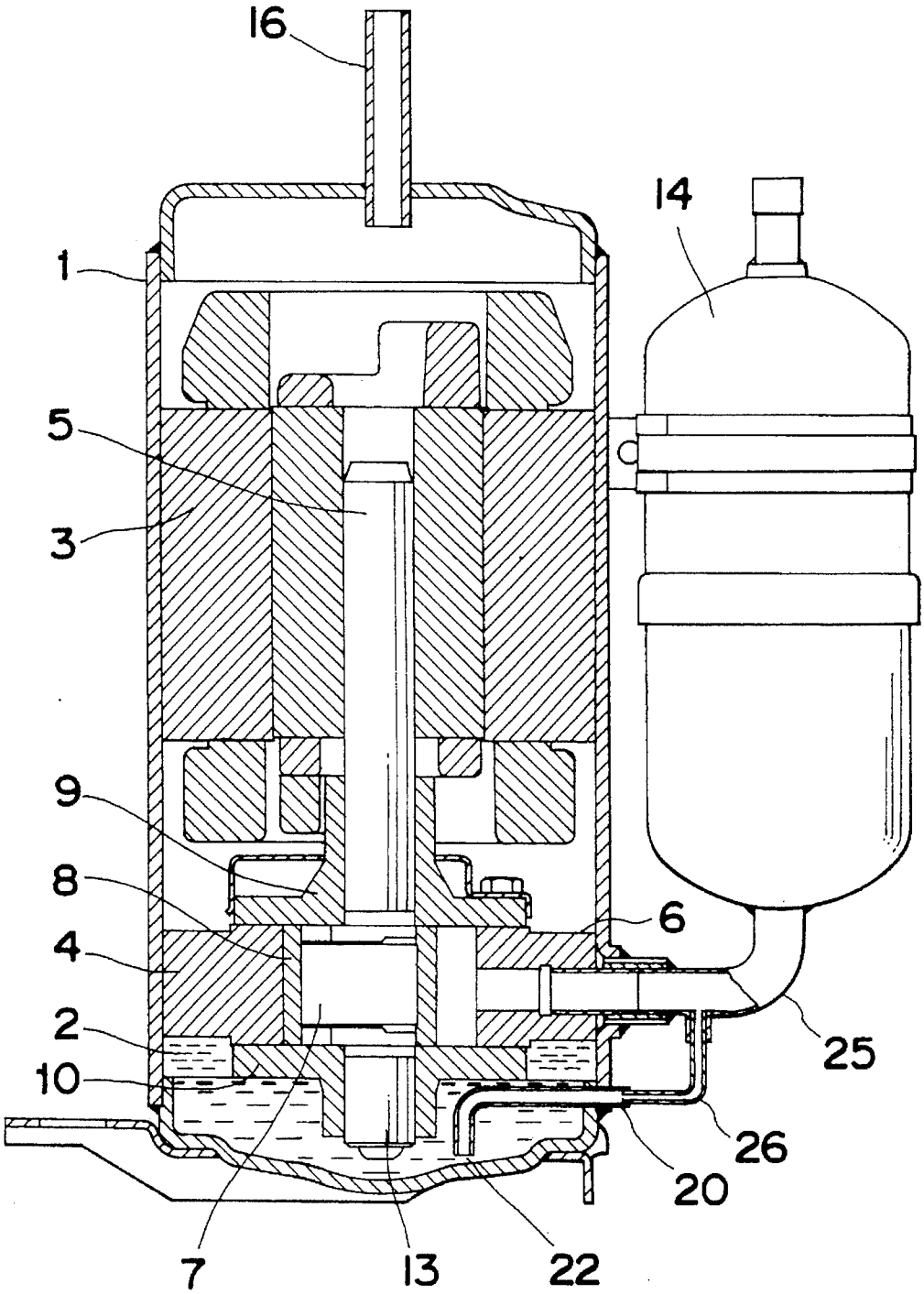
FIG. 9 is a longitudinal sectional view of the rotary compressor according to a sixth preferred embodiment of the present invention.
Figure 24:
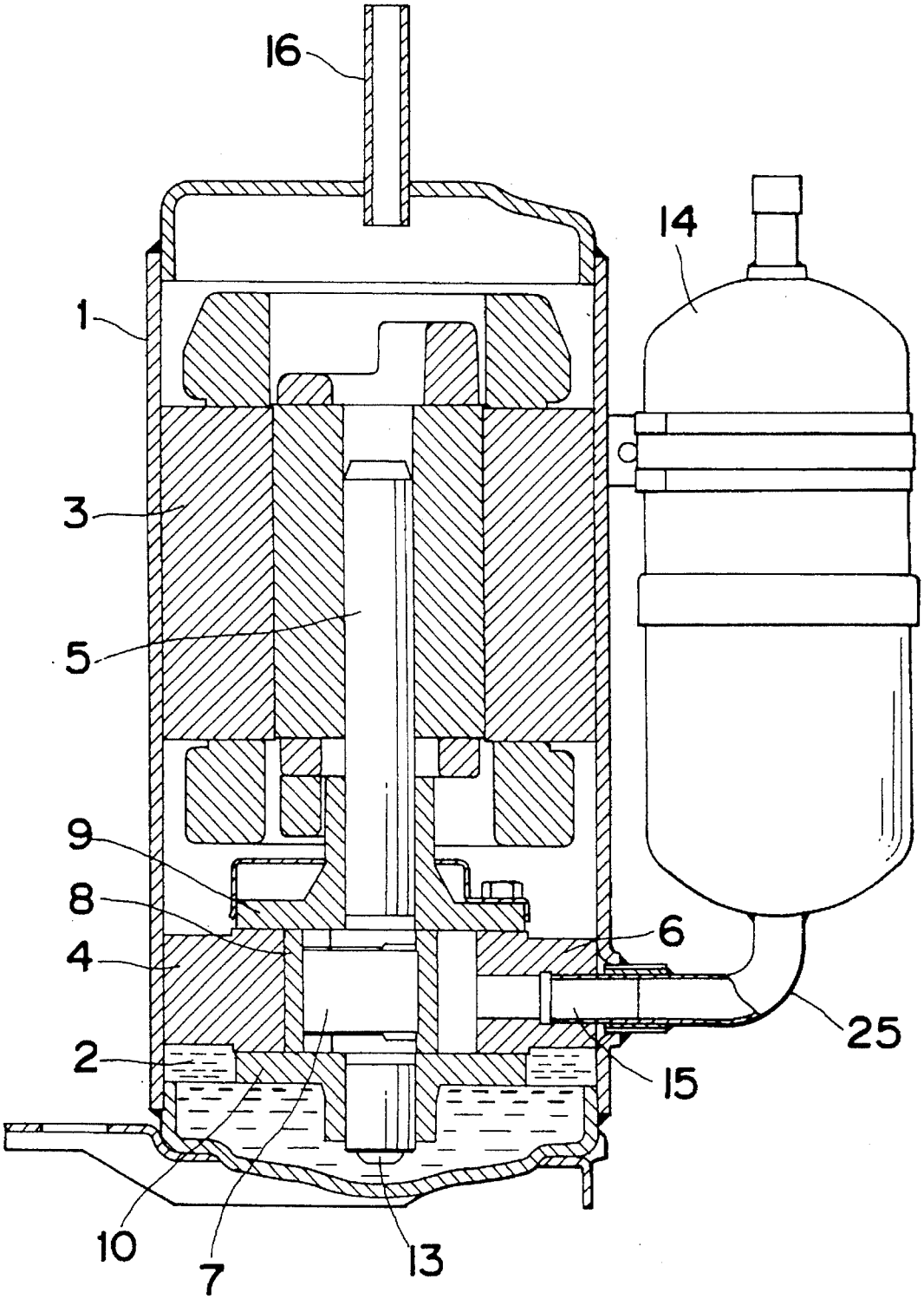
Fig. 24 Prior Art
FIG. 24 is a longitudinal sectional view of the prior art hermetically sealed rotary compressor.
Figure 25:
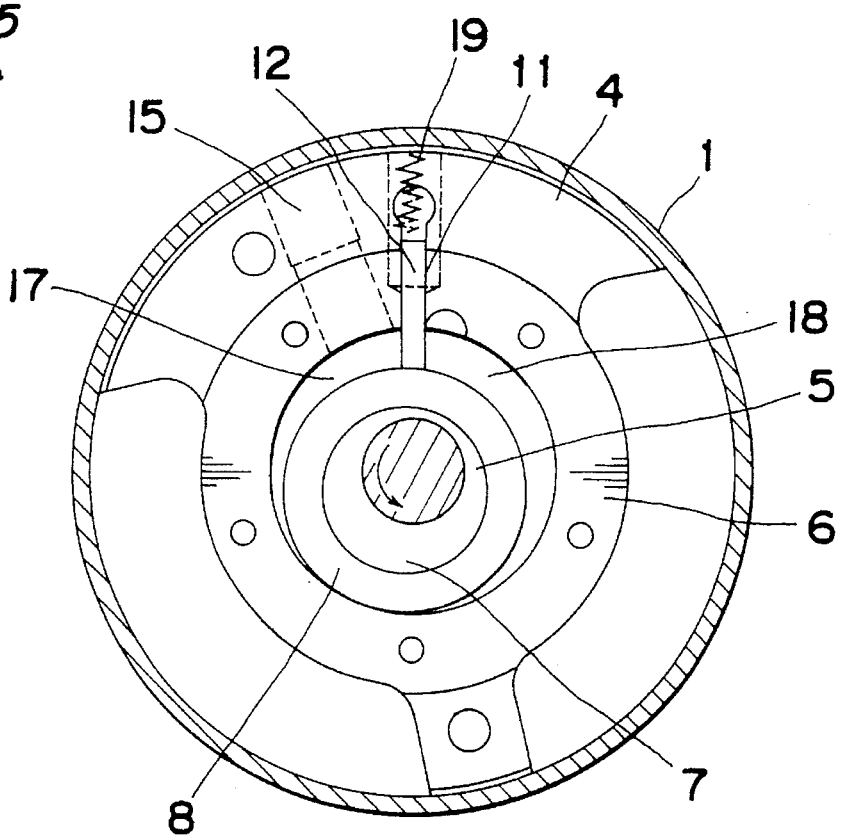
Fig. 25 Prior Art
FIG. 25 is a transverse sectional view of the lower part of the prior art rotary compressor shown in FIG. 24.
Figure 26:
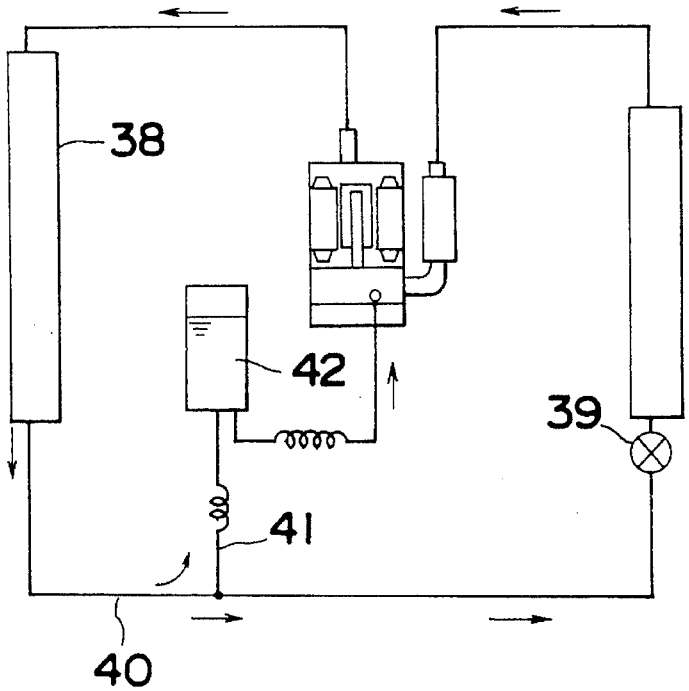
Fig. 26 Prior Art
FIG. 26 is a diagram showing the prior art lubricant injecting system used in association with the prior art hermetically sealed rotary compressor.

FIG. 9 illustrates a sixth preferred embodiment of the present invention. In this embodiment, the oil supply tube 20 has the first open end communicated with the oil reservoir 22 and the second open end fluid-connected with the connecting tube 25 through an orifice 26 that is positioned outside the sealed vessel 1. As discussed in connection with the prior art rotary compressor shown in FIG. 24, the connecting tube 25 supplies the phase-separated refrigerant from the gas-liquid separator 14 to the compression chamber of the compressor mechanism 4 by way of the intake port 15. Thus, it will readily be seen that the lubricating oil 2 within the oil reservoir 22 can be sucked into the compression chamber of the sealed vessel 1 in a controlled quantity and positively sprayed onto the ring-shaped piston 8 together with the refrigerant, thereby enhancing the lubrication.

Figure 10:
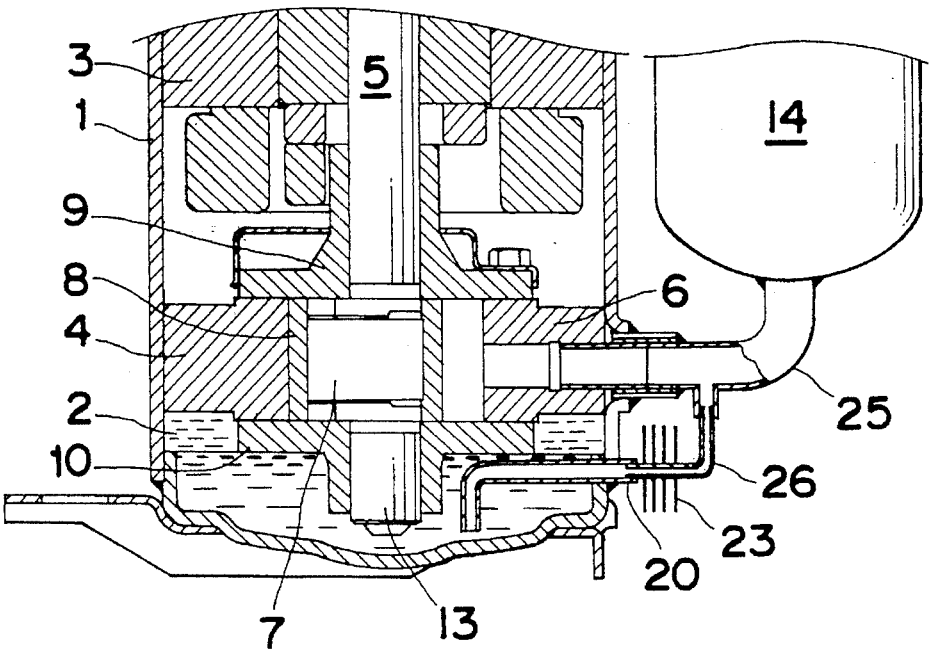
FIG. 10 is a longitudinal sectional view of the lower part of the rotary compressor, showing a modification of the sixth preferred embodiment of the present invention.

The rotary compressor shown in FIG. 9 may also be provided with the heat exchanger 23 as shown in FIG. 10. As thus far shown, the heat exchanger 23 is disposed on the orifice 26 adjacent the oil supply tube 20 and situated outside the sealed vessel 1. However, if desired, it may be disposed on that end portion of the oil supply tube 20 which is situated outside the sealed vessel 1 or the junction between the oil supply tube 20 and the orifice 26.

Figure 11:
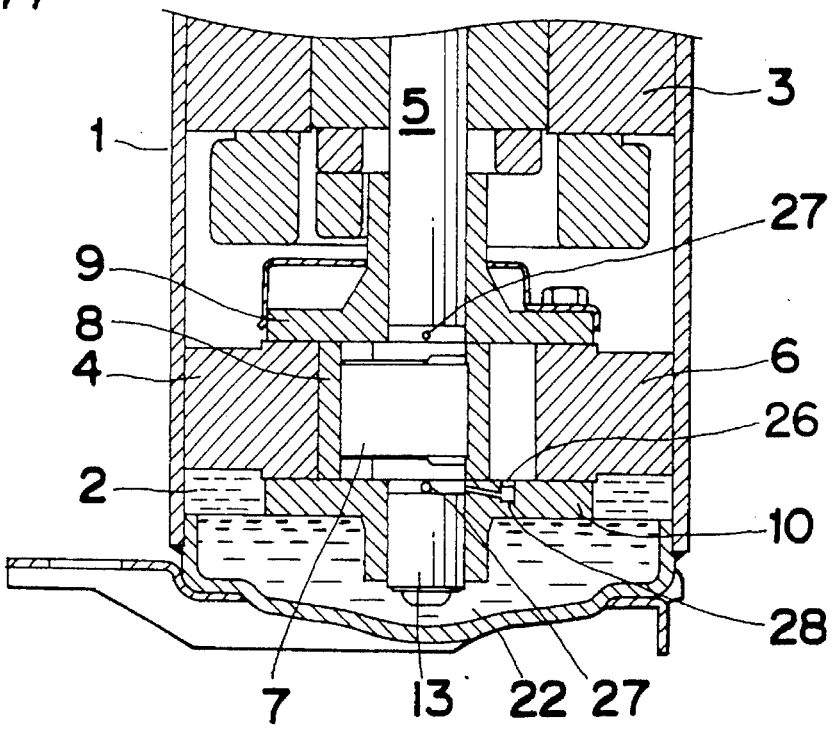
FIG. 11 is a longitudinal sectional view of the lower part of the rotary compressor according to a seventh preferred embodiment of the present invention, respectively.

Referring now to FIG. 11 which shows a seventh preferred embodiment of the present invention, an oil supply passage 28 is defined in the lower bearing plate 10 and has one open end opening into the low pressure chamber 17 is via orifice and the other open end opening into a space for communication with the oil supply port 27.

Figure 12:
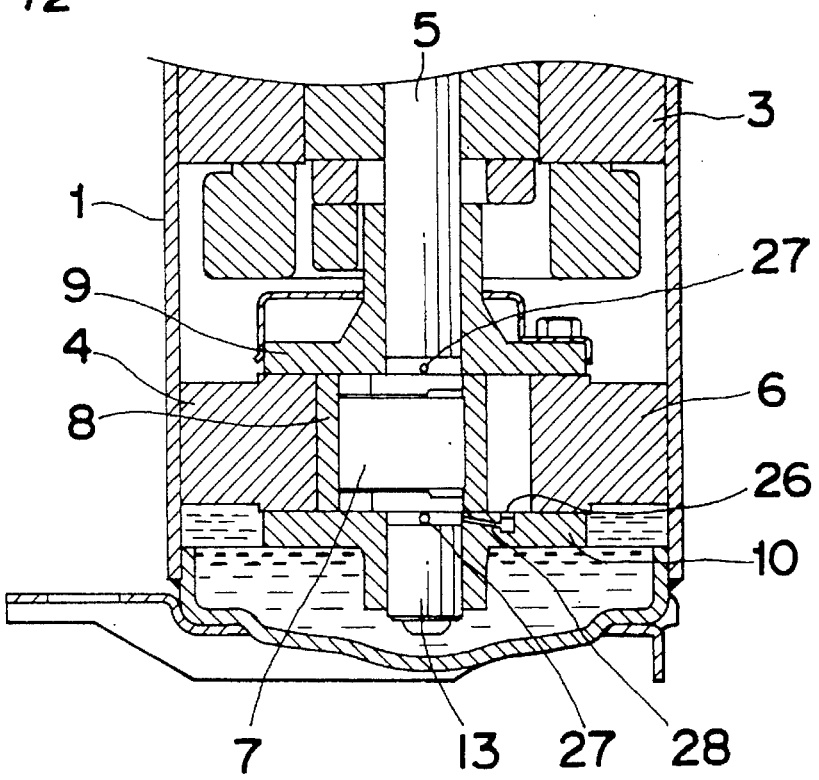
FIG. 12 is a view similar to FIG. 11, showing a modification of the seventh preferred embodiment of the present invention.
Figure 13:
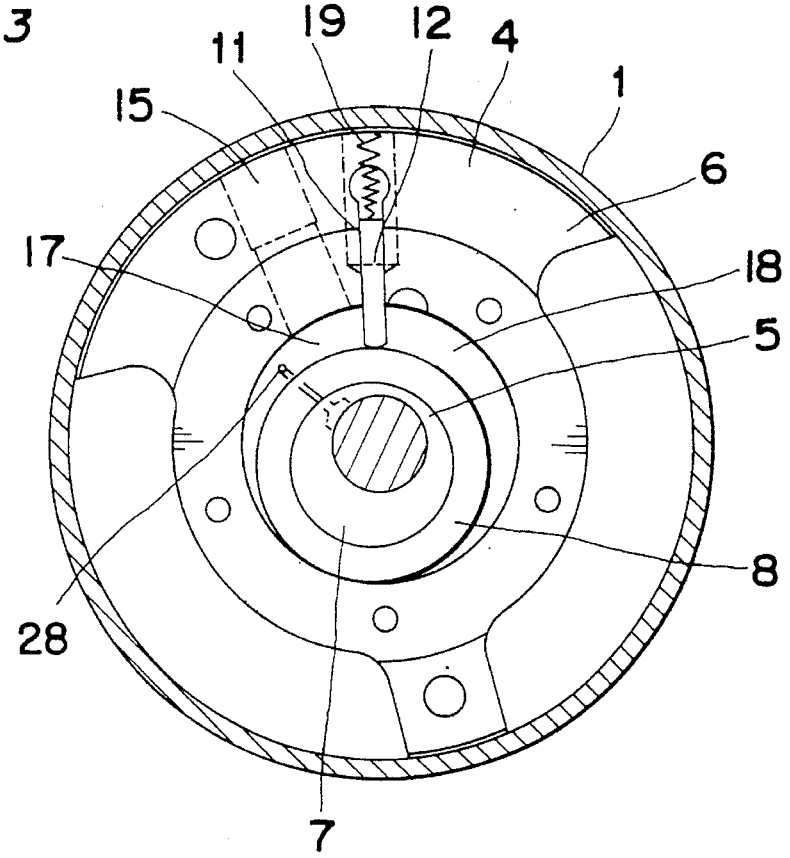
FIG. 13 is a transverse sectional view of the lower part of the rotary compressor shown in any one of FIGS. 11 and 12.

Preferring to FIG 12 as a modification of the seventh embodiment of the present invention, the oil supply passage 28 shown in FIG. 11 may be provided with an orifice 26 which is less restrictive than the orifice of FIG. 11.

Figure 14:
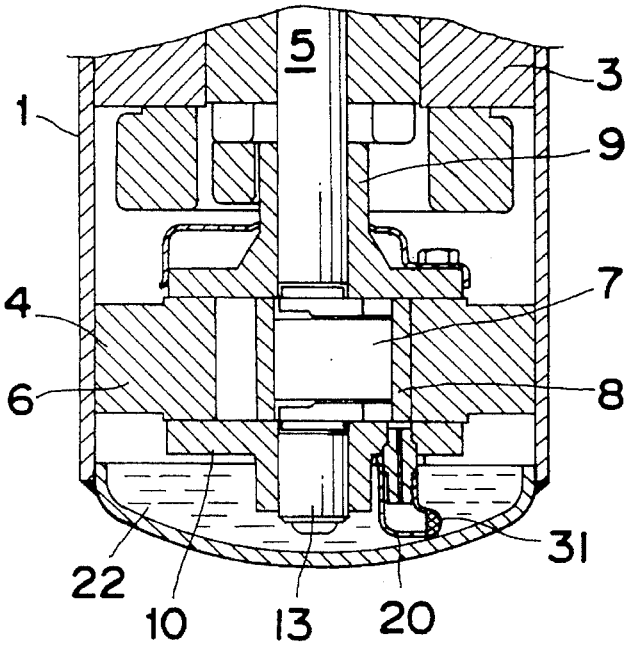
FIG. 14 is a longitudinal sectional view of the lower part of the rotary compressor according to an eighth preferred embodiment of the present invention.
Figure 15:
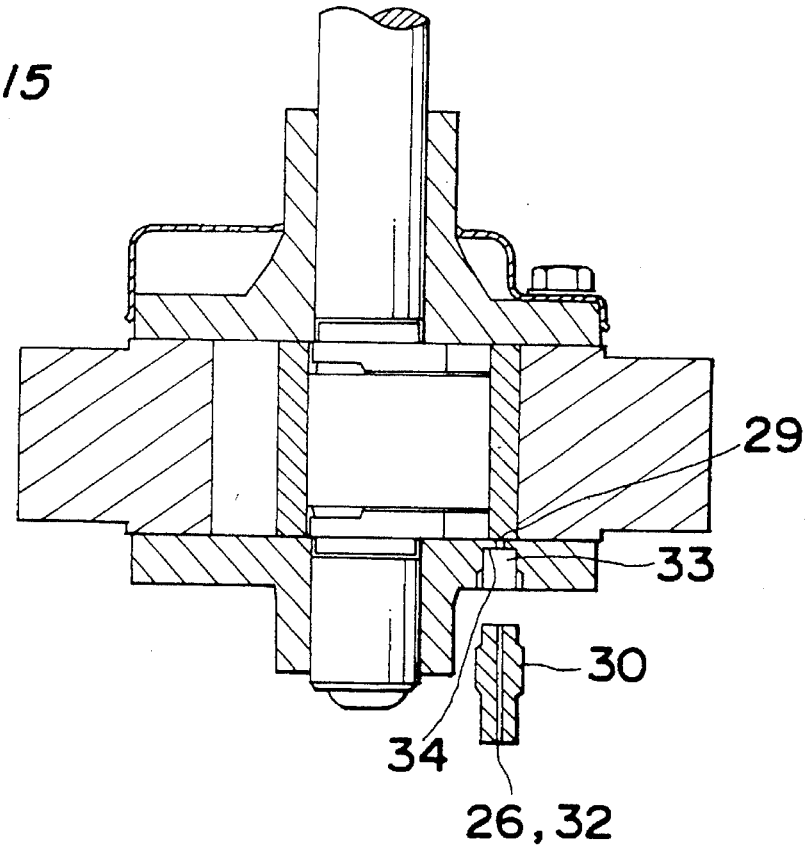
FIG. 15 is a side sectional view, on an enlarged scale, showing the cylinder used in the rotary compressor shown in FIG. 14.
Figure 16:
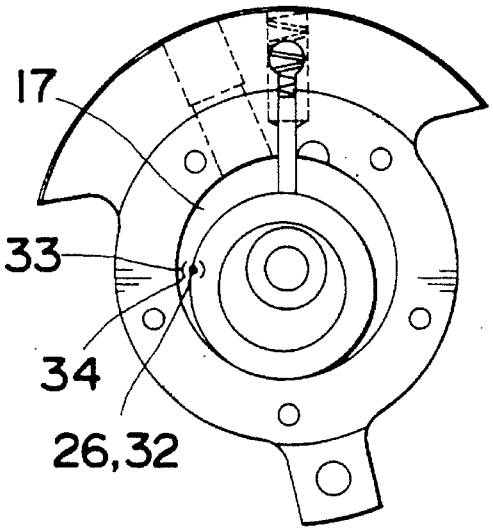
FIG. 16 is a top plan view of the cylinder used in the rotary compressor shown in FIG. 14.

Referring to FIGS. 14 to 16 pertaining to an eighth preferred embodiment of the present invention, the oil reservoir 22 at the bottom of the sealed vessel 1 is communicated with the low pressure chamber 17 in the cylinder 6 through an oil supply conduit which includes a supply port 29 defined on a surface of the lower bearing plate 10 so as to open into the low pressure chamber 17 at a right angle to the plane of rotation of the eccentric cam, a holder 30 having an axial orifice 26 defined therein, and an oil supply tube 20 secured to the lower bearing plate 10 and encasing the holder 30. The first open end of the oil supply tube 20 opposite to the holder 30 and opening into the oil reservoir 22 is provided with a filter 31 for preventing the orifice 26 from being clogged. The details of connection of the holder 30 to the lower bearing plate 10 are shown in FIG. 15.

As shown in FIG. 15, the holder 30 has a capillary tube 32 press-fitted thereinto. This capillary tube 32 has a fine passage of not greater than 1 mm in diameter defined therein, which fine passage serves as an orifice. It is to be noted that, instead of the use of the capillary tube 32, the holder 30 may be axially bored to provide a fine passage.

The lower bearing plate 10 has an internally threaded bearing hole 33 defined therein for threadingly receiving the holder 30. By threading the holder into the bearing hole 33 until the tip of the holder 30 is brought into abutment with an annular shoulder 34 defined at the bottom of the bearing hole 33, a high pressure seal can be obtained. In this way, not only can the holder 30 be simply secured to the lower bearing plate 10, but also the orifice 26 can easily be disposed in the vicinity of the low pressure chamber 17 inside the sealed vessel 1.

If the holder 30 secured to the lower bearing plate 10 has an axial length long enough to reach a position below the surface level of the lubricating oil 2 within the oil reservoir 22, the use of the oil supply tube 20 may be dispensed with if desired.

Figure 17:
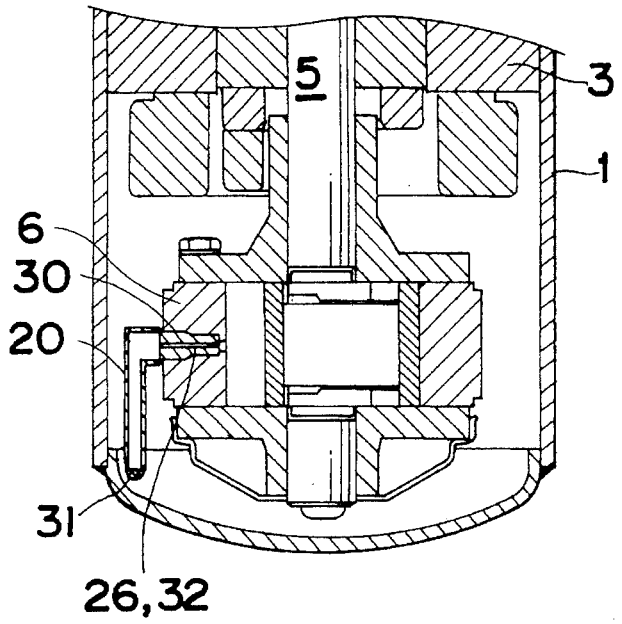
FIG. 17 is a longitudinal sectional view of the lower part of the rotary compressor according to a ninth preferred embodiment of the present invention.
Figure 19:
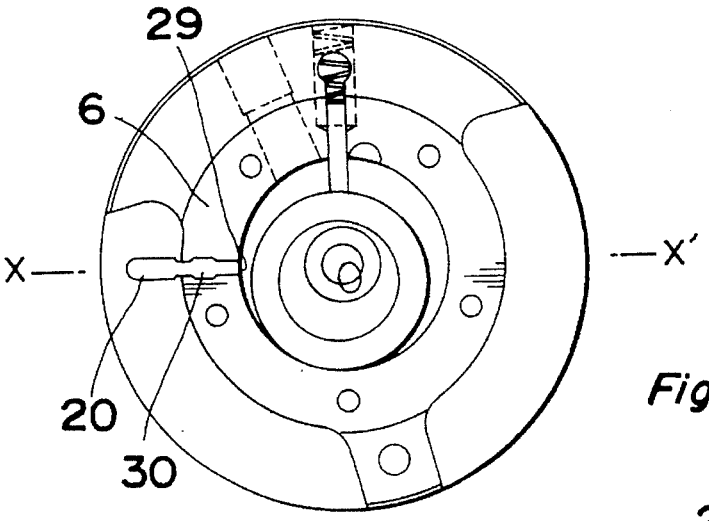
FIG. 19 is a top plan view of the cylinder used in the rotary compressor shown in FIG. 17.
Figure 18:
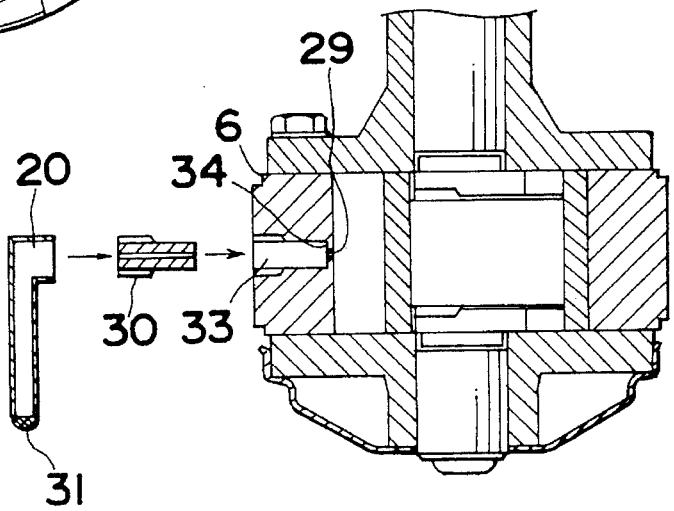
FIG. 18 is a side sectional view, on an enlarged scale, showing the cylinder used in the rotary compressor shown in FIG. 17.

FIGS. 17 to 19 illustrate a ninth preferred embodiment of the present invention. In this embodiment, the peripheral wall of the cylinder 6 is formed with a radial bore 29 and a holder bearing hole 33 defined therein in alignment with each other with the holder 30 firmly threaded into the bearing hole 33 until the tip thereof is brought into abutment with the annular shoulder 34. The oil supply tube 20 extending from the oil reservoir 22 is fluid-coupled with the holder 30.

The oil supply tube 20 employed in the ninth embodiment shown in FIGS. 17 to 19 is of a generally L-shaped configuration having the first and second open ends which are communicated with the oil reservoir 22 and the holder 30, respectively. As is the case with the embodiment shown in FIG. 14, the filter 31 for preventing the orifice 26 from being clogged is fitted to the first open end of the oil supply tube 20.

The details of connection of the holder 30 to the peripheral wall of the cylinder 6 best shown in FIG. 18 are substantially similar to those described with reference to FIG. 15.

The hermetically sealed rotary compressor according to the present invention operates in the following manner.

Assuming that the crankshaft 5 is driven in one direction by the electric motor 3, the planetary motion of the ring-shaped piston 8 allows the gas-phase refrigerant such as HFC to be introduced into the low pressure chamber 17 through the intake port 15. On the other hand, the refrigerant within the high pressure chamber 18 is compressed accompanied by elevation of the temperature thereof and is subsequently discharged into the sealed vessel 1 and then to the discharge tube 16.

During the operation of the rotary compressor, the radial vane 12 dividing the compression compartment of the cylinder 6 into the volumetrically variable low and high pressure chambers 17 and 19 in cooperation with the ring-shaped piston 8 reciprocately slides within the radial groove 11 with the radial inner end thereof constantly held in sliding contact with the ring-shaped piston 8 by the combined force of the biasing spring 19 and the back pressure acting thereon. A region of sliding contact between the radial inner end of the radial vane 12 and the ring-shaped piston 8 is mainly lubricated by a lubricant oil which is mixed in a slight quantity in the refrigerant being sucked through the intake port 15. The quantity of the lubricant sucked into the compression chamber of the cylinder 6 together with the refrigerant is so slight that no sufficient lubrication may be accomplished, and this is particularly true where HFC is employed for the refrigerant to be compressed.

The low pressure chamber 17 on the leading side of the radial vane 12 with respect to the direction of rotation of the crankshaft 5 is low in pressure and, therefore, by the effect of a pressure difference between the low pressure chamber 17 and the oil reservoir 22, the lubricating oil within the oil reservoir 22 is sucked into the oil supply tube 20 and then into the capillary passage 21 after foreign matter contained in the oil reservoir 22 has been removed by the filter 31. Since the lubricating oil within the oil reservoir 22 has been chosen in consideration of the compatibility with the refrigerant used, a substantial amount of the refrigerant is contained therein. Although the lubricating oil containing the refrigerant is of a high temperature and under a high pressure so long as accommodated within the oil reservoir 22, the pressure thereof is reduced as it flows through the orifice. During the reduction in pressure in the orifice, the refrigerant contained in the lubricating oil is evaporated with the resultant vapor cooling the lubricating oil and, therefore, the lubricating oil of a reduced temperature flows into the suction chamber.

In the case of the prior art oil injection system, the oil reservoir has a capillary tube disposed therein and, therefore, reduction of the pressure of the lubricating oil has been effected within the capillary tube immersed in the lubricating oil within the oil reservoir. For this reason, even though the lubricating oil flowing through the capillary tube is cooled, the lubricating oil is again heated readily by exchange with heat of the lubricating oil within the oil reservoir and is then introduced into the low pressure chamber through the intake port, thereby constituting a cause of heating of the gas:phase refrigerant within the cylinder.

In contrast thereto, however, since in the present invention the orifice 26 is disposed in the vicinity of the low pressure chamber 17, the lubricating oil to be supplied into the low pressure chamber 17 is in no way heated again, thereby avoiding a possible reduction in efficiency.

The open end of the radial bore 29 opening into the low pressure chamber 17 is cyclically closed and opened by the ring-shaped piston 8 during the planetary motion thereof to regulate the amount of the lubricating oil supplied into the low pressure chamber 17 in the cylinder 6.

The lubricating oil introduced into the compression compartment of the cylinder 6 penetrates into a region of sliding contact between the radial inner end of the radial vane 12 and the ring-shaped piston 8 to form an oil film to thereby minimize any possible frictional wear of one or both of the radial vane 12 and the ring-shaped piston 8. The lubricating oil after having been used to oil the sliding region is subsequently discharged from the compressor mechanism 4 together with the compressed refrigerant, most of which is then thrown off as it flows through cutouts in the electric motor 3 so as to return to the oil reservoir 2. In this way, the quantity of the lubricating oil which may be Circulated through the refrigerating circuit is minimized to avoid any possible reduction in heat exchange efficiency of a heat exchanger while increasing the refrigerating efficiency.

Also, since the lubricating oil to be introduced into the low pressure chamber 17 flows through the orifice 26, the higher the pressure difference, the more the lubricating oil is mixed in. Hence, the higher the pressure difference, the more the lubricating oil is introduced into the sliding region, accompanied by an increase in reliability.

Figure 20:
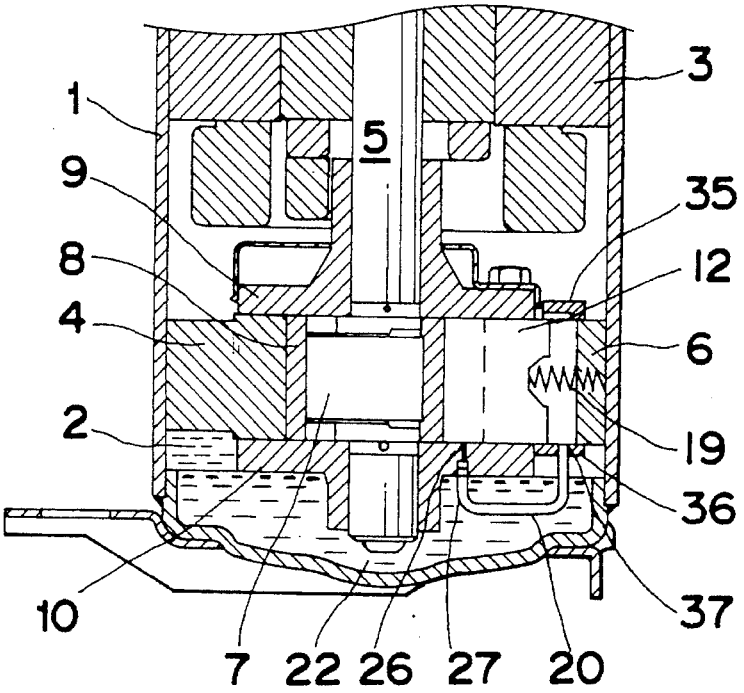
FIG. 20 is a longitudinal sectional view of the lower part of the rotary compressor according to a tenth preferred embodiment of the present invention.
Figure 21:
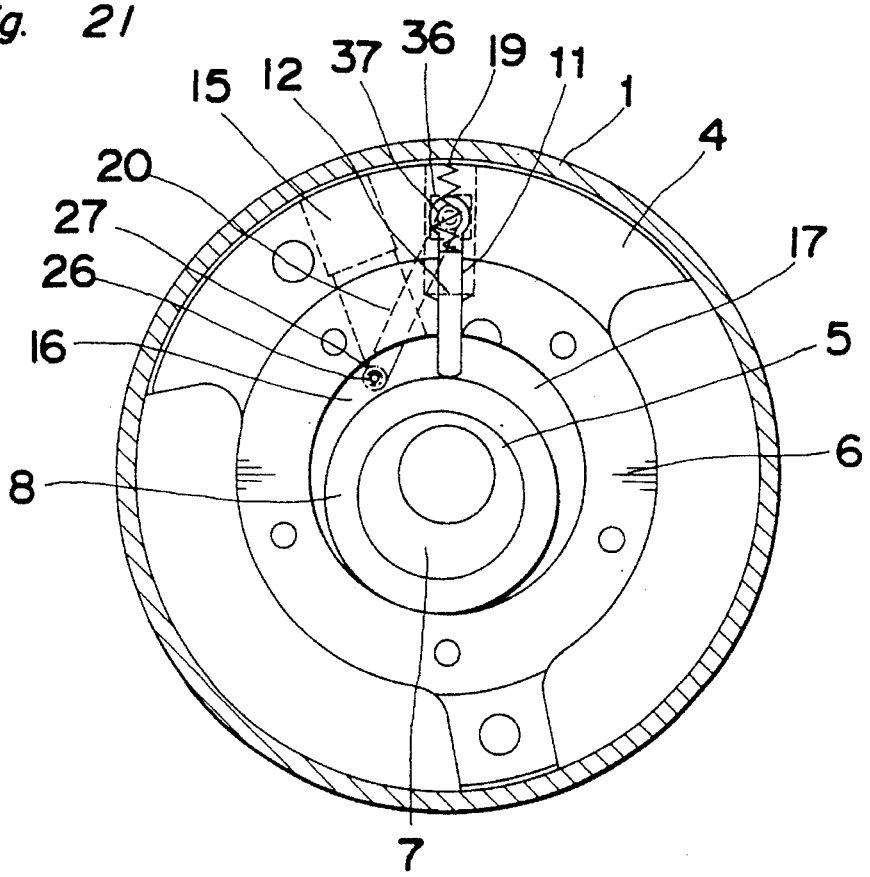
FIG. 21 is a transverse sectional view of the lower part of the rotary compressor shown in FIG. 20.
Figure 22:
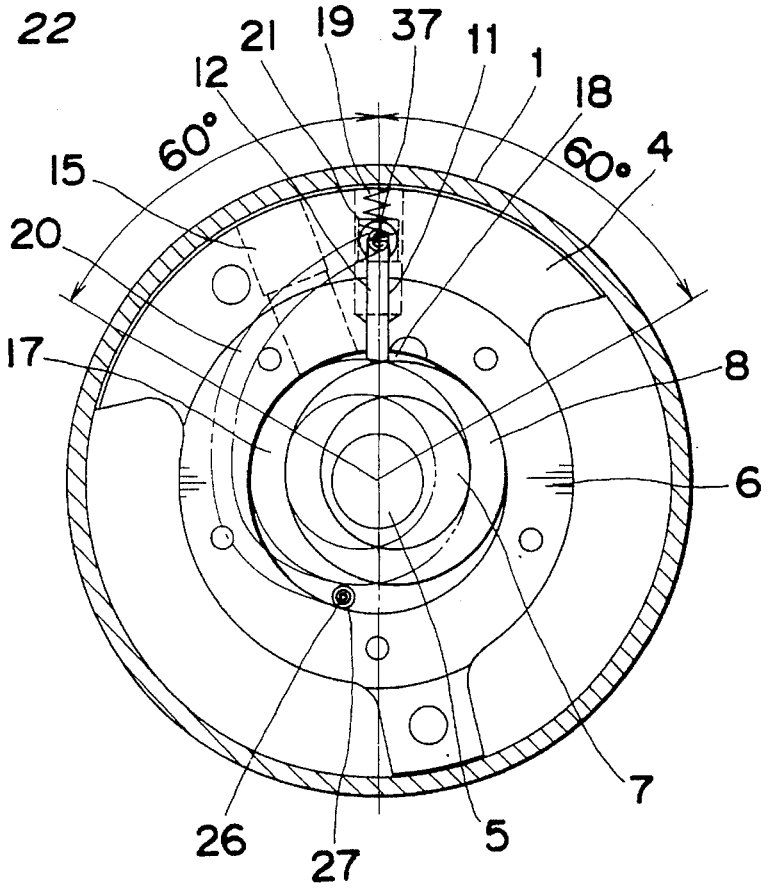
FIG. 22 is a transverse sectional view of the lower part of the rotary compressor.

Referring to a tenth preferred embodiment of the present invention shown in FIG. 20, top and bottom cover plates 35 and 36 are employed so as to cover top and bottom openings of the radial groove 11, respectively. Specifically, the top cover plate 35 is fixedly mounted on the cylinder 6 so as to cover the top opening of the radial groove 11 that is outside the perimeter of the upper bearing plate 9 whereas the bottom cover plate 36 is secured to the cylinder 6 from below so as to cover the bottom opening of the radial groove that is outside the perimeter of the lower bearing plate 10 and at a location adjacent the top dead center of the ring-shaped piston 8. The bottom cover plate 36 is formed with a bearing hole 37 across the thickness thereof, the bearing hole 37 being fluid-connected with the second open end of the oil supply tube 20. The first open end of the oil supply tube 20 is in turn fluid-connected with a supply port 27 defined in the lower bearing plate 10 and communicated with the low pressure chamber 17 through the orifice 26.

Where the supply port 27 is defined at such a location that the supply port 27 opens into the low pressure chamber 17 at ±60° relative to the top dead center of the ring-shaped piston 8, the quantity of the lubricating oil supplied into the low pressure chamber 17 can be adjusted to accomplish both of the lubrication and an increase in operating efficiency.

Figure 23:
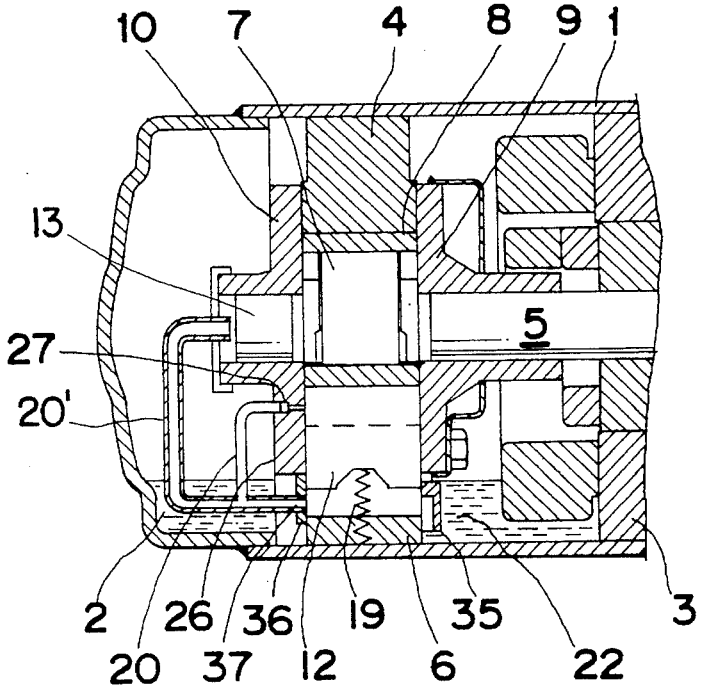
FIG. 23 is a longitudinal sectional view of the lower part of the rotary compressor according to an eleventh preferred embodiment of the present invention.

FIG. 23 illustrates an eleventh preferred embodiment of the present invention. This embodiment applies to a horizontally laid version of the hermetically sealed rotary compressor, i.e., the hermetically sealed rotary compressor installed with the crankshaft 5 laid horizontally. In the case of the horizontally laid version, the oil supply tube 20 shown in FIG. 20 has a branch passage 20' communicated with the oil supply pump 13.

Thus, according to the embodiment shown in FIG. 23, even though the rotary compressor is installed with its longitudinal axis oriented horizontally, the lubricant oil can be positively supplied to the various sliding regions, particularly the sliding region between the wall defining the vane groove 11 and the radial vane 12.

In FIGS. 20 and 23 the radial vane 12 reciprocates upon eccentric rotation of the piston 8, and when the vane is moved to the right as shown in FIGS. 20 and 23 the vane will cause oil present in the groove 11 to be fed into the tube 20.

From the foregoing description, it has now become clear that it is possible to supply the lubricating oil to the various sliding regions without being heated. This is partly because, in One aspect of the present invention, the lubricating oil being supplied outwardly from the oil reservoir is cooled in exchange of heat with the ambient air or by the heat exchanger as it flows through that portion of the oil supply tube situated outside the sealed vessel and partly because, in another aspect of the present invention, during the flow of the lubricating oil through the orifice, the refrigerant contained in the lubricating oil is evaporated with the resultant vapor cooling the lubricating oil. The present invention is effective to avoid any possible heating of the refrigerant to be compressed by the rotary compressor which would otherwise constitute a cause of reduction in operating efficiency of the rotary compressor.

Although the present invention has been described in connection with the preferred embodiments thereof with reference to the accompanying drawings, it is to be noted that various changes and modifications will be apparent to those skilled in the art. By way of example, while in the foregoing description of any one of the various preferred embodiments of the present invention, reference has been made to the use of the HFC refrigerant being compressed, the present invention may not be limited to the use of the HFC refrigerant and may be equally applicable to the use of any other conventional refrigerant such as CFC 12 or HCFC 22. Even where the conventional refrigerant such as CFC 12 or HCFC 22 is employed for the refrigerant being compressed in the rotary compressor, effects similar to those discussed above can be obtained.

Such changes and modifications are to be understood as included within the scope of the present invention as defined by the appended claims, unless they depart therefrom.

What is claimed is:

1. A hermetically sealed rotary compressor comprising:

a generally cylindrical sealed vessel having an oil reservoir defined therein;

a drive unit housed within said sealed vessel and including a drive motor and a crankshaft operably coupled with said drive motor;

a compressor mechanism housed within said sealed vessel, said compressor mechanism comprising a cylinder having a compression compartment defined therein and also having upper and lower openings, an eccentric cam fixed for rotation with said crankshaft, and a ring-shaped piston encircling said eccentric cam and capable of undergoing a planetary motion in contact with said eccentric cam during rotation of said eccentric cam, said cylinder also having a refrigerant intake port defined therein in communication with said compression compartment;

upper and lower bearing plates closing said upper and lower openings of said cylinder, respectively;

a radial vane radially slidably accommodated in said cylinder, said radial vane having a radial inner end held in sliding contact with an outer peripheral surface of said ring-shaped piston;

an oil supply passage communicating between said oil reservoir and said compression compartment;

wherein said oil supply passage comprises a capillary passage having first and second ends, said first end of said capillary passage being fluid-connected to said oil reservoir, and said capillary passage being disposed immediately adjacent said compression compartment such that said second end of said capillary passage opens directly into said compression compartment.

2. The hermetically sealed rotary compressor as claimed in claim 1, wherein said second end of said capillary passage is located adjacent said refrigerant intake port.

3. The hermetically sealed rotary compressor as claimed in claim 1, further comprising a heat exchanger disposed on an intermediate portion of said oil supply passage.

4. The hermetically sealed rotary compressor as claimed in claim 1, further comprising a flow regulating valve disposed in said oil supply passage.

5. The hermetically sealed rotary compressor as claimed in claim 4, wherein said flow regulating valve is disposed on an intermediate portion of said oil supply passage; and a heat exchanger is disposed on an intermediate portion of said oil supply passage so as to encompass said flow regulating valve.

6. The hermetically sealed rotary compressor as claimed in claim 1, wherein said capillary passage is defined in said cylinder.

7. The hermetically sealed rotary compressor as claimed in claim 6, wherein said capillary passage extends in a radial direction.

8. The hermetically sealed rotary compressor as claimed in claim 1, wherein said capillary passage is defined in one of said upper and lower bearing plates.

9. The hermetically sealed rotary compressor as claimed in claim 8, wherein said capillary passage extends in a radial direction.

10. The hermetically sealed rotary compressor as claimed in claim 1, wherein said capillary passage has a diameter of not greater than 1 mm.

11. The hermetically sealed rotary compressor as claimed in claim 1, wherein said radial vane divides said compression compartment into low and high pressure chambers defined on leading and trailing sides of said radial vane with respect to a rotation direction of said crankshaft;

said refrigerant intake port opens into said low pressure chamber; and said capillary passage opens directly into said low pressure chamber.

12. The hermetically sealed rotary compressor as claimed in claim 1, further comprising a holder secured to said lower bearing plate;

wherein said capillary passage is defined in said holder; and wherein a cyclic opening and closing of said second end of said capillary passage occurs upon occurrence of the planetary motion of said ring-shaped piston.

13. The hermetically sealed rotary compressor as claimed in claim 12, wherein said ring-shaped piston has opposing axial end faces and an outer peripheral surface; and one of said end faces of said ring-shaped piston constitutes a means for cyclically opening and closing said second end of said capillary passage upon occurrence of the planetary motion of said ring-shaped piston.

14. The hermetically sealed rotary compressor as claimed in claim 12, wherein said ring-shaped piston has opposing axial end faces and an outer peripheral surface; and said outer peripheral surface of said ring-shaped piston constitutes a means for cyclically opening and closing said second end of said capillary passage upon occurrence of the planetary motion of said ring-shaped piston.

15. The hermetically sealed rotary compressor as claimed in claim 1, wherein said second end of said capillary passage opens into said compression compartment at a location within 60 degrees of top dead center of the planetary motion of said ring-shaped piston.

16. The hermetically sealed rotary compressor as claimed in claim 1, wherein said radial vane is slidably accommodated in a radial groove formed in said cylinder;

a top cover plate closes a top opening of said radial groove; and a bottom cover plate closes a bottom opening of said radial groove.

17. The hermetically sealed rotary compressor as claimed in claim 1, wherein said compressor mechanism constitutes a means for compressing a refrigerant comprising hydroflourocarbon; and said oil reservoir constitutes a means for accommodating a lubricating oil which has compatibility with said refrigerant.

18. A hermetically sealed rotary compressor comprising:

a generally cylindrical sealed vessel having an oil reservoir defined therein;

a drive unit housed within said sealed vessel and including a drive motor and a crankshaft operably coupled with said drive motor;

a compressor mechanism housed within said sealed vessel, said compressor mechanism comprising a cylinder having a compression compartment defined therein and also having upper and lower openings, an eccentric cam fixed for rotation with said crankshaft, and a ring-shaped piston encircling said eccentric cam and capable of undergoing a planetary motion in contact with said eccentric cam during rotation of said eccentric cam, said cylinder also having a refrigerant intake port defined therein in communication with said compression compartment;

upper and lower bearing plates closing said upper and lower openings of said cylinder, respectively;

a radial vane radially slidably accommodated in said cylinder, said radial vane having a radial inner end held in sliding contact with an outer peripheral surface of said ring-shaped piston;

an oil supply tube having first and second ends, said first end being communicated with said oil reservoir;

a capillary passage having first and second ends, said first end of said capillary passage being fluid-connected to said second end of said oil supply tube, and said second end of said capillary passage being communicated with said compression compartment; and wherein a portion of said oil supply tube intermediate said first and second ends thereof extends outside said sealed vessel.

19. The hermetically sealed rotary compressor as claimed in claim 18, wherein said second end of said capillary passage is located adjacent said refrigerant intake port.

20. The hermetically sealed rotary compressor as claimed in claim 18, further comprising a heat exchanger disposed on said intermediate portion of said oil supply tube.

21. The hermetically sealed rotary compressor as claimed in claim 18, further comprising a flow regulating valve disposed on said oil supply tube.

22. The hermetically sealed rotary compressor as claimed in claim 18, wherein said flow regulating valve is disposed on said intermediate portion of said oil supply tube; and a heat exchanger is disposed on said intermediate portion of the oil supply tube so as to encompass said flow regulating valve.

23. The hermetically sealed rotary compressor as claimed in claim 18, wherein said capillary passage is defined in said cylinder.

24. The hermetically sealed rotary compressor as claimed in claim 23, wherein said capillary passage extends in a radial direction.

25. The hermetically sealed rotary compressor as claimed in claim 18, wherein said capillary passage is defined in one of said upper and lower bearing plates.

26. The hermetically sealed rotary compressor as claimed in claim 25, wherein said capillary passage extends in a radial direction.

27. The hermetically sealed rotary compressor as claimed in claim 18, wherein said capillary passage has a diameter of not greater than 1 mm.

28. The hermetically sealed rotary compressor as claimed in claim 27, wherein said capillary passage is disposed immediately adjacent said compression compartment such that said second end of said capillary passage opens directly into said compression compartment.

29. The hermetically sealed rotary compressor as claimed in claim 18, wherein said capillary passage is disposed immediately adjacent said compression compartment such that said second end of said capillary passage opens directly into said compression compartment.

30. The hermetically sealed rotary compressor as claimed in claim 18, wherein said radial vane divides said compression compartment into low and high pressure chambers defined on leading and trailing sides of said radial vane with respect to a rotation direction of said crankshaft;

said refrigerant intake port opens into said low pressure chamber; and said capillary passage opens directly into said low pressure chamber.

31. The hermetically sealed rotary compressor as claimed in claim 18, further comprising a holder secured to said lower bearing plate;

wherein said capillary passage is defined in said holder; and wherein a cyclic opening and closing of said second end of said capillary passage occurs upon occurrence of the planetary motion of said ring-shaped piston.

32. The hermetically sealed rotary compressor as claimed in claim 31, wherein said ring-shaped piston has opposing axial end faces and an outer peripheral surface; and one of said end faces of said ring-shaped piston constitutes a means for cyclically opening and closing said second end of said capillary passage upon occurrence of the planetary motion of said ring-shaped piston.

33. The hermetically sealed rotary compressor as claimed in claim 31, wherein said ring-shaped piston has opposing axial end faces and an outer peripheral surface; and said outer peripheral surface of said ring-shaped piston constitutes a means for cyclically opening and closing said second end of said capillary passage upon occurrence of the planetary motion of said ring-shaped piston.

34. The hermetically sealed rotary compressor as claimed in claim 18, wherein said second end of said capillary passage opens into said compression compartment at a location within 60 degrees of top dead center of the planetary motion of said ring-shaped piston.

35. The hermetically sealed rotary compressor as claimed in claim 18, wherein said radial vane is slidably accommodated in a radial groove formed in said cylinder;

a top cover plate closes a top opening of said radial groove; and a bottom cover plate closes a bottom opening of said radial groove.

36. The hermetically sealed rotary compressor as claimed in claim 18, wherein said compressor mechanism constitutes a means for compressing a refrigerant comprising hydroflourocarbon; and said oil reservoir constitutes a means for accommodating a lubricating oil which has compatibility with said refrigerant.

* * * * *